US010124978B1

(12) United States Patent
Szymonski et al.

(10) Patent No.: US 10,124,978 B1
(45) Date of Patent: Nov. 13, 2018

(54) DISPENSER FOR WRAPPING PAPER AND RELATED SUPPLIES WITH INTEGRAL STORAGE FEATURE

(71) Applicants: Tonya Szymonski, Anchorage, AK (US); Trena Rairdon, Anchorage, AK (US)

(72) Inventors: Tonya Szymonski, Anchorage, AK (US); Trena Rairdon, Anchorage, AK (US)

( * ) Notice: Subject to any disclaimer, the term of this patent is extended or adjusted under 35 U.S.C. 154(b) by 0 days.

(21) Appl. No.: 15/812,082

(22) Filed: Nov. 14, 2017

(51) Int. Cl.
*B65D 69/00* (2006.01)
*B65H 35/00* (2006.01)

(52) U.S. Cl.
CPC ..... *B65H 35/002* (2013.01)

(58) Field of Classification Search
USPC ..... 206/575, 225, 226, 391, 806
See application file for complete search history.

(56) References Cited

U.S. PATENT DOCUMENTS 8,210,348 B1 * 7/2012 Chapman ..... A47B 63/02 206/391
2007/0163907 A1 * 7/2007 Turner ..... B65D 5/5069 206/416
2007/0193917 A1 * 8/2007 Munoz ..... B25H 3/022 206/575
2008/0245699 A1 * 10/2008 Salazar ..... A47F 13/00 206/575
2010/0072243 A1 * 3/2010 Pelton ..... B65H 35/002 225/49
2012/0125794 A1 * 5/2012 Elash ..... B65H 35/002 206/389
2013/0001113 A1 * 1/2013 Levine ..... A45C 15/00 206/225

* cited by examiner

*Primary Examiner* — Jacob K Ackun
(74) *Attorney, Agent, or Firm* — Michael J. Tavella

(57) ABSTRACT

A dispenser for wrapping paper that allows a user to store a number of rolls of paper, ribbons and tape on the device. A sheet of the desired paper can be pulled from a roll and cut, using a sheet cutter installed on the device. Spools of ribbon are installed on the device for ready dispensing. A tape dispenser is also installed with a sawtooth cutter for quick and easy tape dispensing. The device is designed for quick and easy replacement of paper rolls, spools of ribbon and tape. Finally, when the projects are finished, the device can be stored in a closet by hanging it on a bar using a hook provided on the device. This lets the device hang at a height that makes it convenient to retrieve and store as needed.

14 Claims, 10 Drawing Sheets

DISPENSER FOR WRAPPING PAPER AND RELATED SUPPLIES WITH INTEGRAL STORAGE FEATURE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to dispensers for wrapping paper and particularly to dispensers for wrapping paper and assorted supplies that have a mechanism for storage.

2. Description of the Prior Art

Gift wrapping paper, ribbons, tape and other supplies have been used for decades. Often, these items tend to be placed in closets in an haphazard fashion. When needed, people have to wade through rolls of paper and unmarked bags of supplies-only to dump everything back again when the current project is finished.

Over the years, devices have been invented to help reduce the clutter and to get better organization of these materials. Examples of such devices are found in the following U. S. Patents. U.S. Pat. No. 2,730,310 teaches a paper roll holder. While functional, this device has no storage for supplies like ribbons or tape. Moreover, it lacks a convenient way to store it with a roll or rolls in place. U.S. Pat. No. 3,132,784 teaches a dispenser for wrapping paper that also acts as a package for store displays or for mailing. The device is designed to hold 3 rolls of paper, but lacks any convenient place to store supplies. U.S. Pat. No. 7,424,843 teaches a storage system for a roll of paper. This device includes a sheet cutter in which the user pulls out a quantity of paper and then slides the cutter along a track on the top of the device to cut the sheet off. This device seems to lack the ability to hold multiple rolls of paper as well as storage for supplies. U.S. Pat. No. 7,665,612 discloses a storage box for wrapping paper and supplies that is designed for store display. While it does organize and hold the papers and supplies, it does nothing to help dispense the papers. The user must open the box, remove the top plate, which has depressions to hold the papers upright, then remove the desired paper roll. The problem is that once the top plate is removed, there is nothing to keep the papers from falling sideways in the box. After that, trying to replace the top cover would be a futile exercise. U.S. Pat. No. 8,210,348 teaches a true organizer and storage system. However, this device has problems. It has a staggered system for holing rolls of paper based on the height of the roll. It also has a drawer for holding supplies and a door that opens to store flat items. The main problem is that the drawer has to be removed to gain access to the lower tiers of papers. This is, at best, an inconvenience. The device also has a box structure with wheels to allow it to roll wherever needed. U. S. Patent Publication No. 2005/0127083 teaches a box that can hold up to ten rolls of wrapping paper. The device also has a sawtooth cutter on the front edge for cutting off a sheet of paper. The box also has storage for a roll of tape. Finally, U. S. Patent Publication No. 2011/0174678 teaches a storage container that has a center box portion with a number of drawers for holding supplies and a number of tubes attached to the perimeter of the box to hold the rolls of paper. This device does have a lot of storage, however, it is merely a holder for the paper and supplies—not a dispenser. The user must remove a roll, lay out a sheet, cut the sheet, dig out the desired ribbons and tape and wrap the package. There is no dispensing in this device.

BRIEF DESCRIPTION OF THE INVENTION

The instant invention provides a dispenser for wrapping paper that allows a user to store a number of rolls of paper, ribbons and tape on the device. A sheet of the desired paper can be pulled from a roll and cut, using a sheet cutter installed on the device. Spools of ribbon can be installed on the device for ready dispensing. A tape dispenser is also installed with a sawtooth cutter for quick and easy tape dispensing. The device is designed for quick and easy replacement of paper rolls, spools of ribbon and tape. Finally, when the projects are finished, the device can be stored in a closet by hanging it by using a hook provided on the device. This lets the device hang at a convenient height for storage, which makes it convenient to retrieve and store as needed. Finally, by hanging the device, it get the device up off the floor of a closet. This saves the rolls from being buried, mixed up or damaged. Moreover, by hanging the device valuable floor space in the closet is saved for other things. When stored, the device is compact and takes up little space.

It is an object of the invention to produce an all-inclusive tool that stores and incorporates all accessories needed for gift wrapping.

It is another object of the invention to produce an all-inclusive tool that contains a built in cutter to cut paper and ribbon to size.

It is yet another object of the invention to produce an all-inclusive tool in which the built in blade rod allows the user to measure and cut ribbon & paper.

It is yet another object of the invention to produce an all-inclusive tool that reduces the need for scissors.

It is a further object of the invention to produce an all-inclusive tool that hangs and stores away.

It is yet another object of the invention to produce an all-inclusive tool that holds varied lengths of wrapping paper rolls and multiple spools of ribbon.

It is yet another object of the invention to produce an all-inclusive tool that allows for each separate roll of paper to be cut without requiring the paper roll to be removed. Finally, it is yet another object of the invention that saves closet floor space when stored.

DETAILED DESCRIPTION OF THE INVENTION

Figure 1:
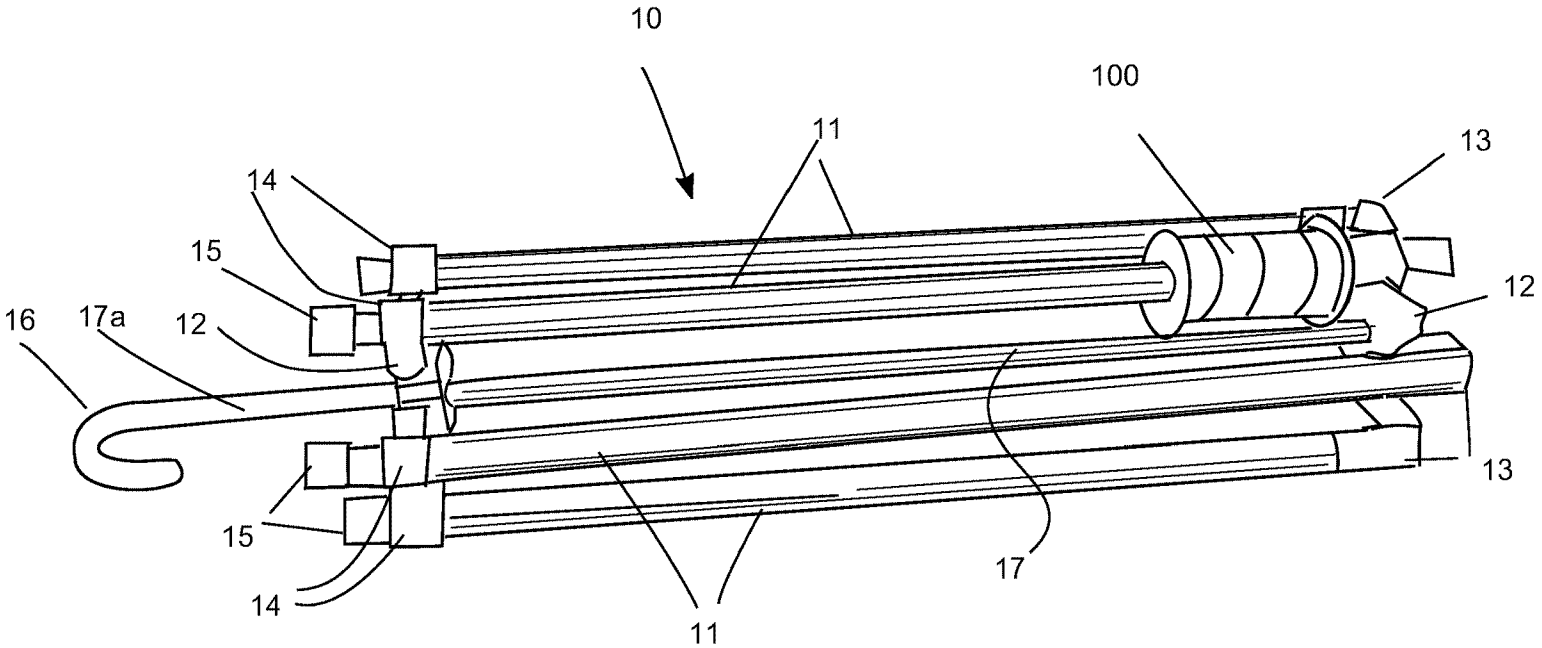
FIG. 1 is a perspective view of a first embodiment of the device.

Referring now to the drawings and in particular to FIG. 1. a perspective view of a first embodiment 10 of the device is shown. The invention consists of a number of tubes 11 that are connected to hubs at both ends of the device. The hubs 12 are the same (see FIGS. 2-4) and have a number of outward extending receptacles formed on them. In the first embodiment the distal hub has elbow fittings 13 in the receptacles (either inserted or formed integrally to them) and the proximate hub is fitted with rings 14 in the receptacles (see also FIG. 2). The tubes passing through the rings 14 are fitted with caps 15 as shown. The caps 15 are removable so that rolls of wrapping paper (not shown) and other supplies, such as spools of ribbon 100, can be slid onto the tubes for use.

A center tube 17 is provided to hold a hook 16 and shaft 17*a*. The hook 16 is used to hang the device in a closet, for example, when not needed. In this way, the device can be quickly stored out of the way while keeping the wrapping supplies organized, protected, and ready for use when needed.

Figure 2:
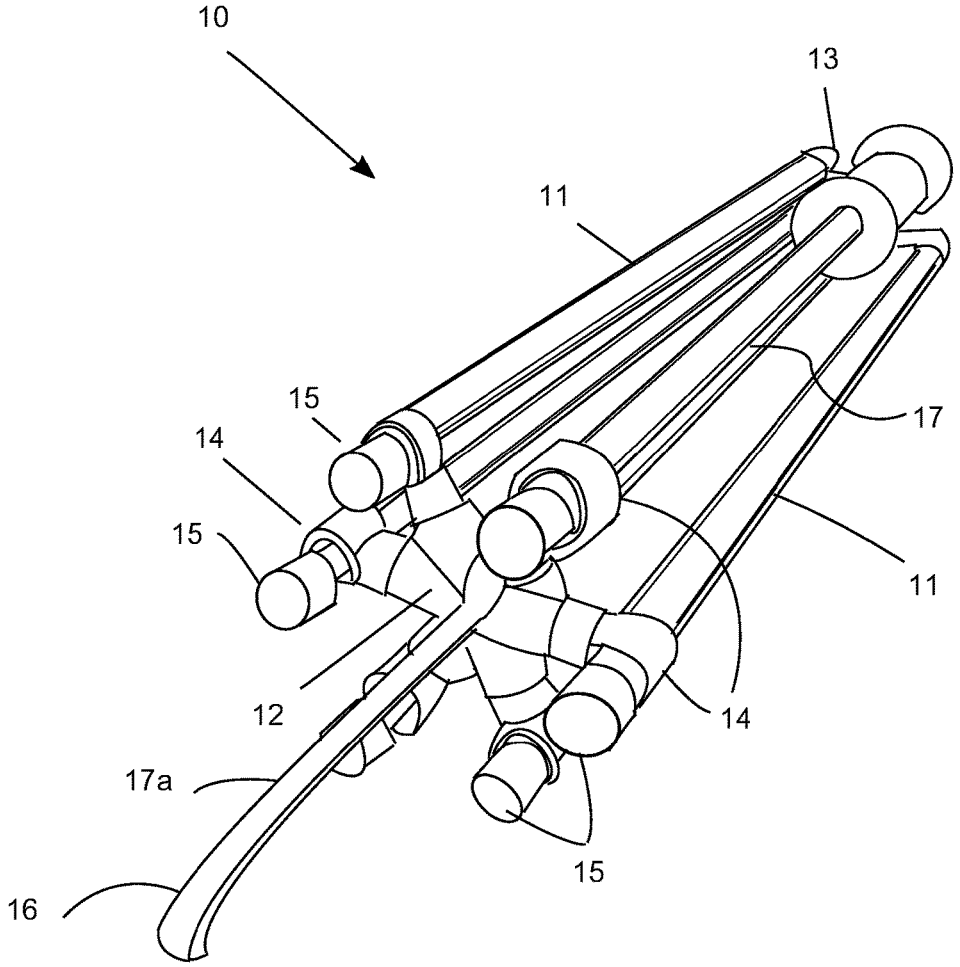
FIG. 2 is a left side perspective view of the first embodiment.

FIG. 2 is a left side perspective view of the first embodiment. In this view, the hook 16 and shaft 17*a* are shown. Note that the shaft 17*a* is shown extended. This view also shows the proximate hub 12 with the rings 14. The tubes 11 are shown with the end caps 15. Note the spool of ribbon 100 is also shown at the end of one of the tubes.

Figure 3:
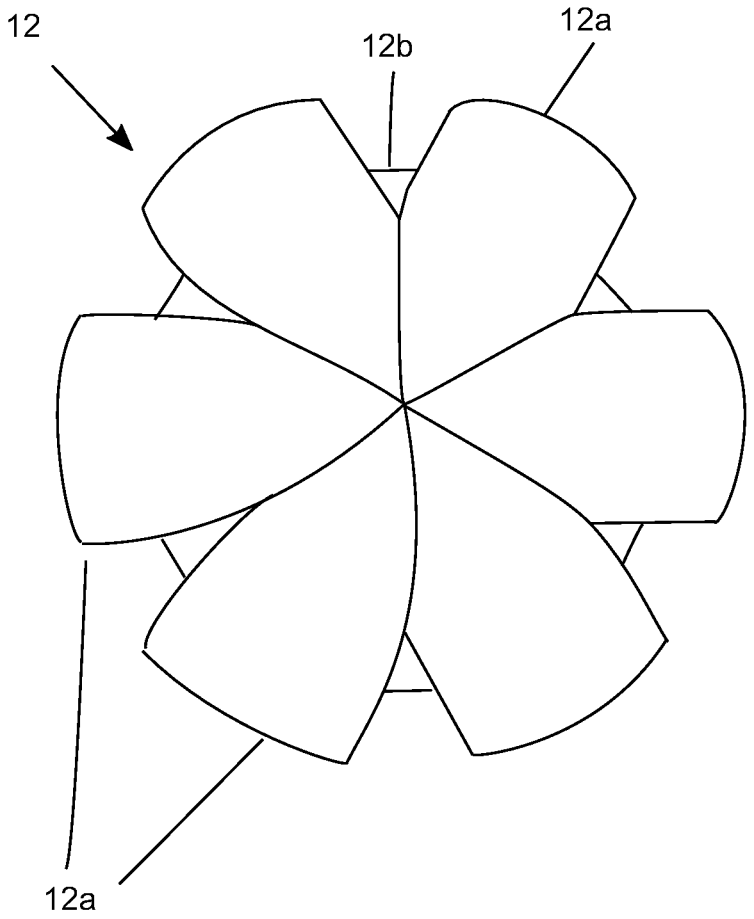
FIG. 3 is an outside view of one embodiment of end hub.

FIG. 3 is an outside view of one embodiment of end hub. The hubs 12 can be made using a 3-D printer, or can be cast or molded. Each hub 12 has a number of receptacles 12*a* and a center plate 12*b* (see also FIG. 4). In the first embodiment, the hubs 12 have six receptacles 12*a*, as shown. The second embodiment has a hub with four receptacles 20 (see e. g., FIG. 5). The hub receptacles 12*a* can be open and are designed to accept elbow fitting 13 or the rings 14 as shown on FIGS. 1 and 2. The receptacles also can have fittings formed integrally to them. In this way, the device can be assembled with several different configurations.

Figure 4:
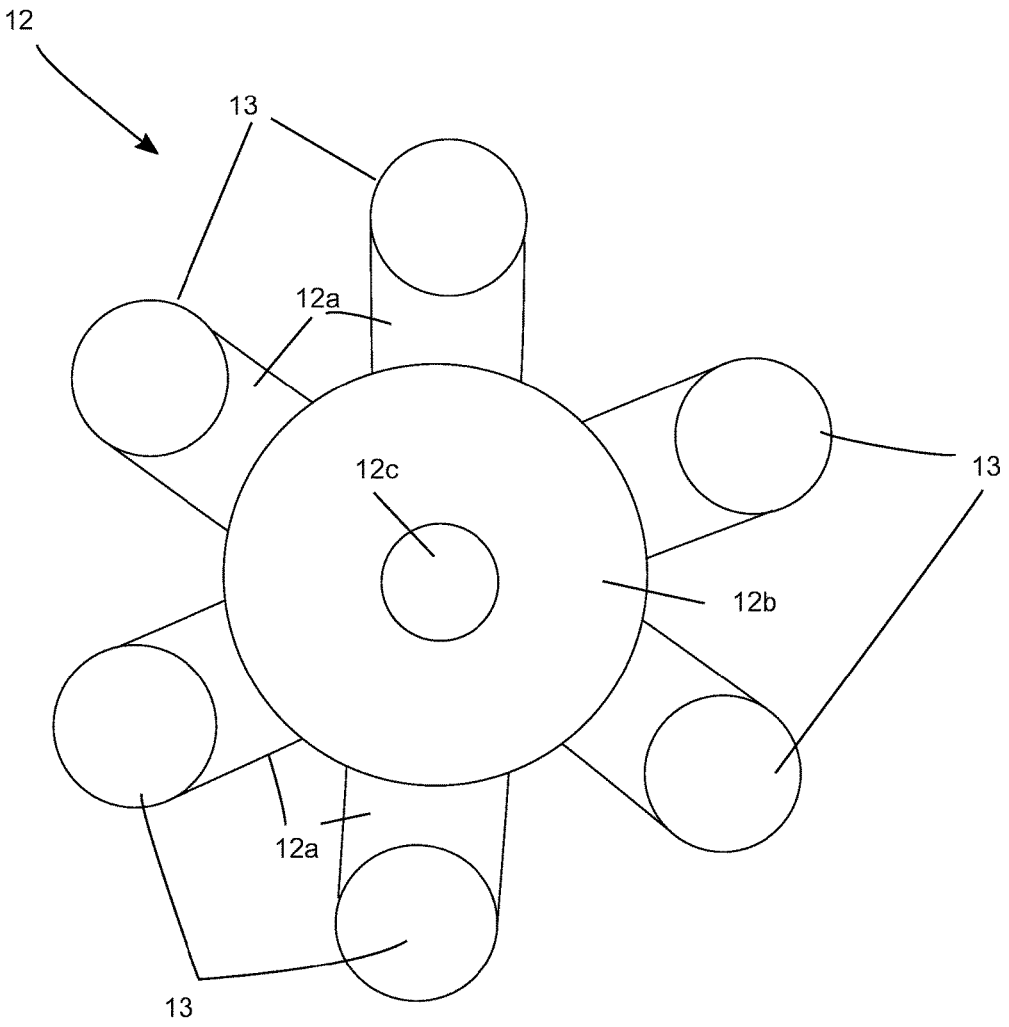
FIG. 4 is an inside view of the hub of FIG. 3 showing the integral elbows in place.

FIG. 4 is an inside view of the hub of FIG. 3 showing the integral elbows in place. Here, the hub 12 is shown with six receptacles 12*a* as before. However, the integral elbows 12*b* are also shown. Note that this side of the hub 12 has a plate 12*c* that has a hole 12*d* in it. This hole allows the rod 17 to be positioned as shown in FIGS. 1 and 2.

Figure 5:
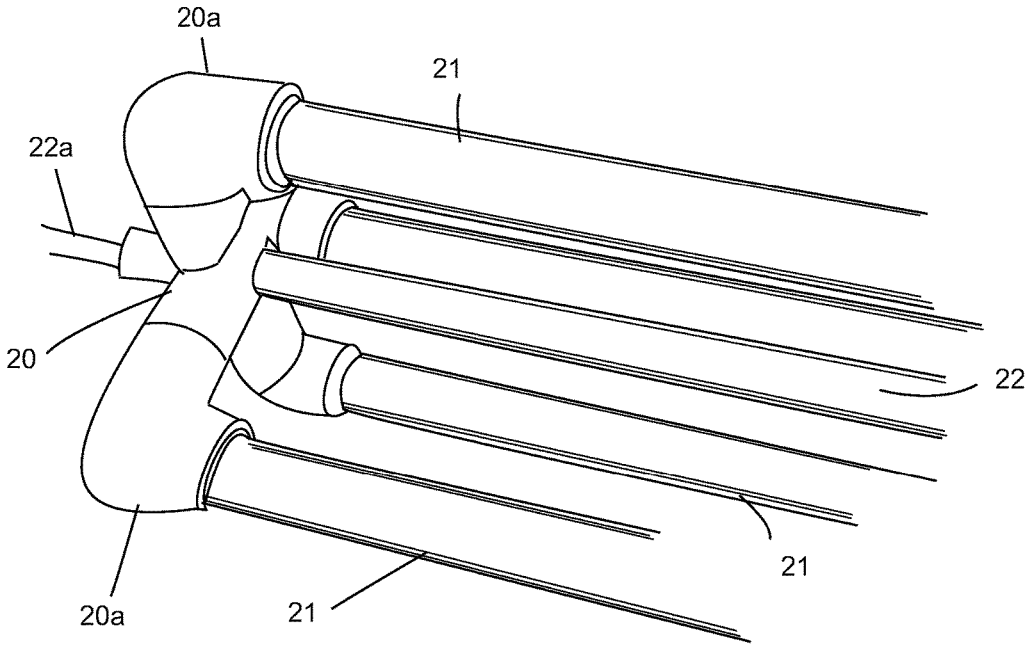
FIG. 5 is a left end view of a scone embodiment of hub.

FIG. 5 is a left end view of a second embodiment of hub 20. In this view, the hub 20 is shown with four elbows 20*a* that hold four tubes 21. Note that there is a center rod 22 that passes through the hub as shown. This center rod holds a telescoping hook 23 (see FIG. 8). Note that the hook 25 can be extendible, but can also be fixed, if desired.

Figure 6:
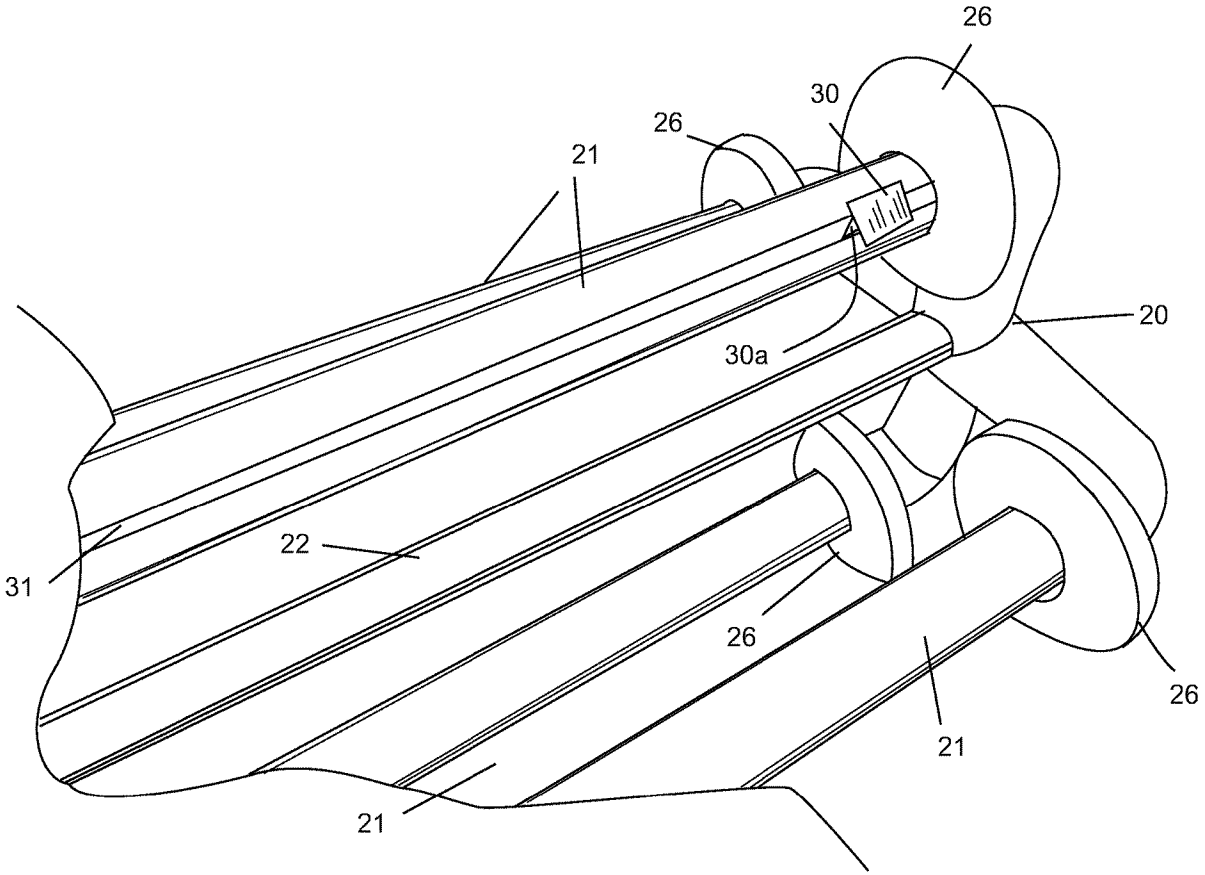
FIG. 6 is a right end view of the second embodiment showing the slide cutter.

FIG. 6 is a right end view of the second embodiment showing the slide cutter. In this figure, the other end of the tubes 21 and 22 is shown. Note that these tubes all terminate in a second hub 20. Note too, that in this embodiment, large disks 26 are positioned as shown. These disks help hold full rolls of wrapping paper on the device-especially when the device is suspended in a closet by the hook 23. Of course, the disks can be used in the first embodiment as well. However, note that the four tube embodiment allows for larger rolls to be used as there is more space between the tubes. Thus, the six tube hub 12 carries more varieties of paper on smaller rolls, while the second embodiment carries fewer rolls with more paper on them. As noted above, FIG. 6 shows that one of the tubes 21*a* has a slide cutter attached. Again, this tube can be used with the first embodiment as well. The slide cutter has a handle 30 with a blade 30*a* that is held in a slot 31 formed in the tube. To use, the handle is placed at one end of the tube 21*a* and a length of paper is then placed over the tube 21*a*, The handle is then slid along the slot 31 with the blade cutting the paper as it moves. Because the blade cuts both ways, once on the other side of the tube, the paper is cut and the cutter is positioned for the next cut.

Note too that, as in the case of the first embodiment, spools of ribbon can be placed on one of the tubes along with a short roll of paper, or no paper at all.

Figure 7:
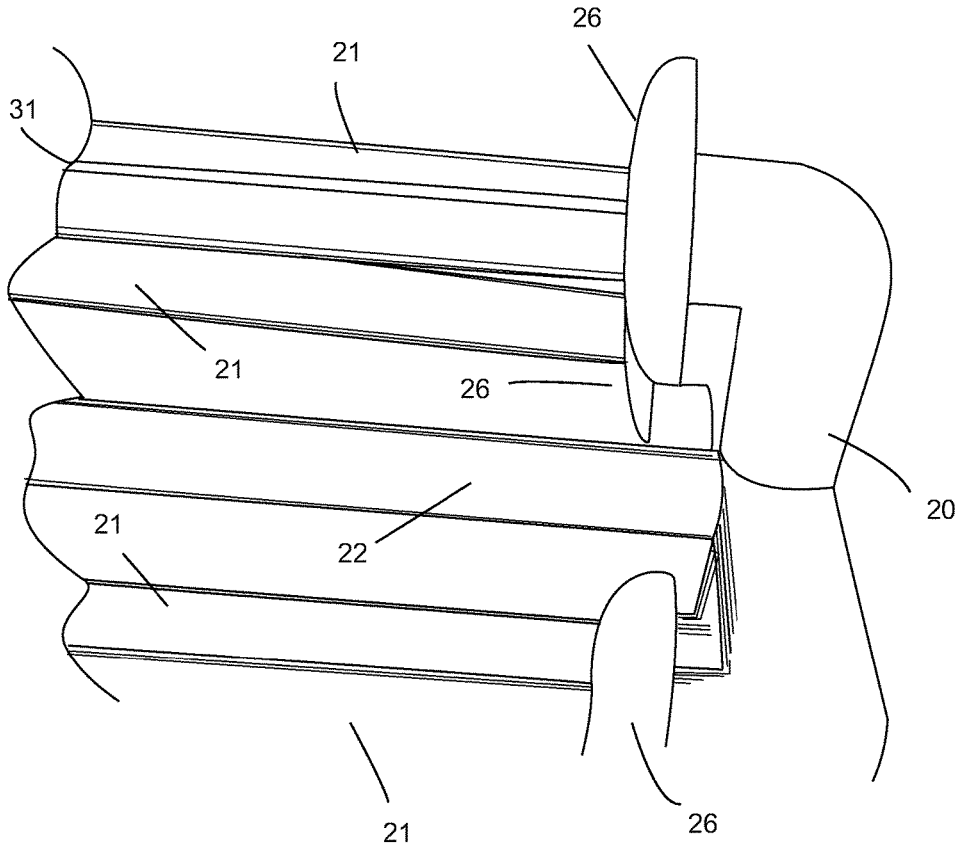
FIG. 7 is a right end detail of the second embodiment showing the tubes in place.

FIG. 7 is a right end detail of the second embodiment showing the tubes 21 and 22 as well as the large disks 26 in place on the hub 20

Figure 8:
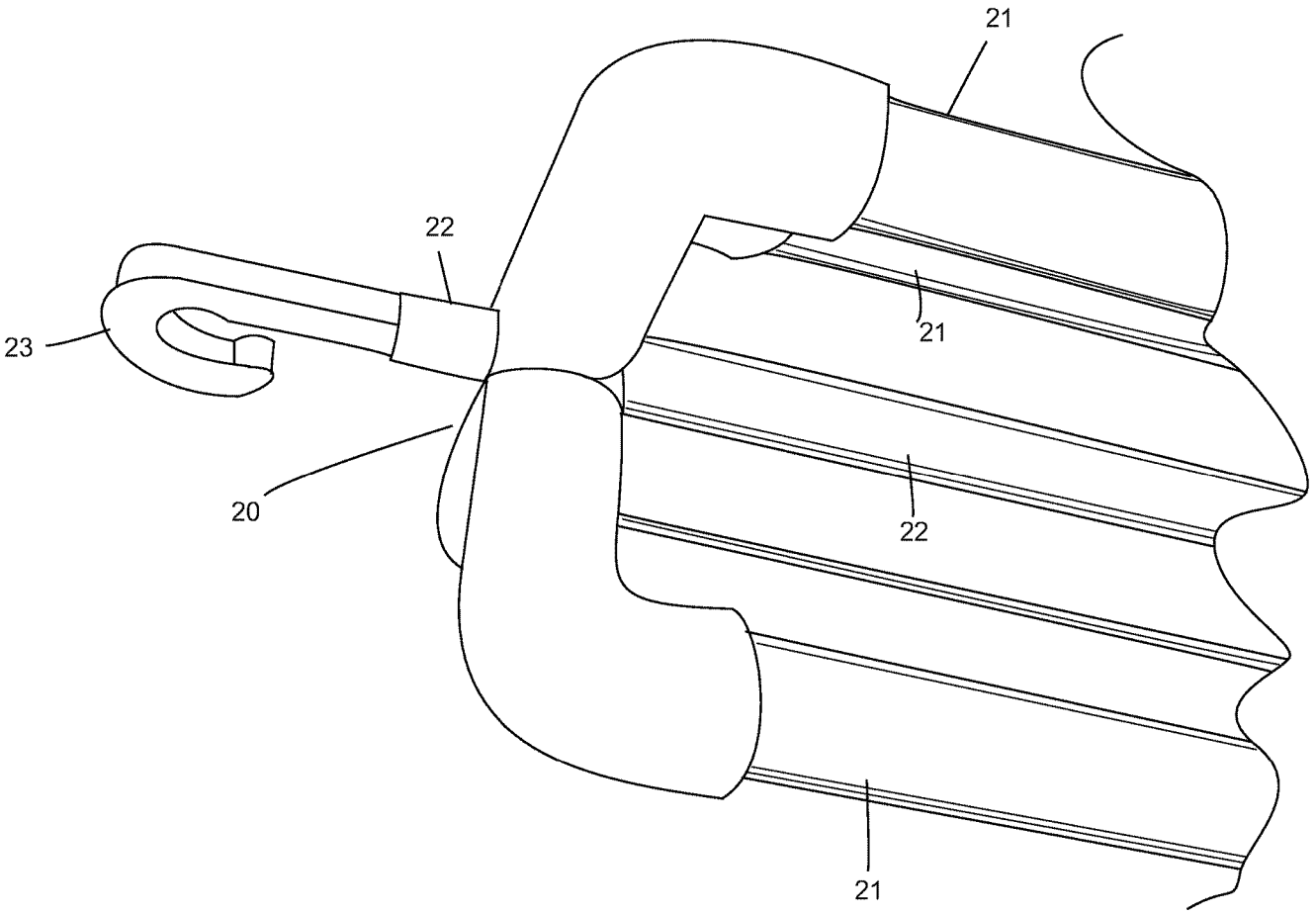
FIG. 8 is a left end detail view showing the integral hook used for hanging the device when stored.

FIG. 8 is a left end detail view showing the integral hook 23 used for hanging the device when stored. Note that the hook 23 is shown exiting tube 22, which is shown passing through the hub 20.

Figure 9:
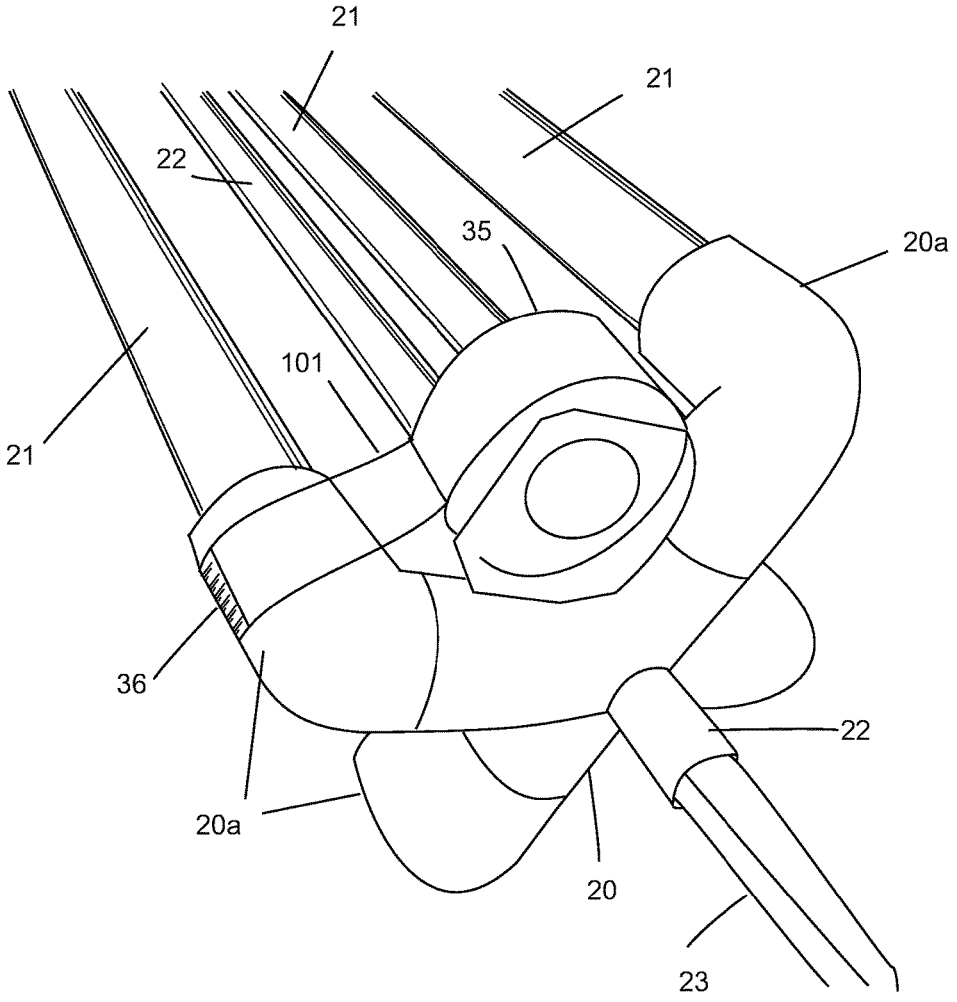
FIG. 9 is a detail view of the second embodiment showing an integral tape dispenser.
Figure 10:
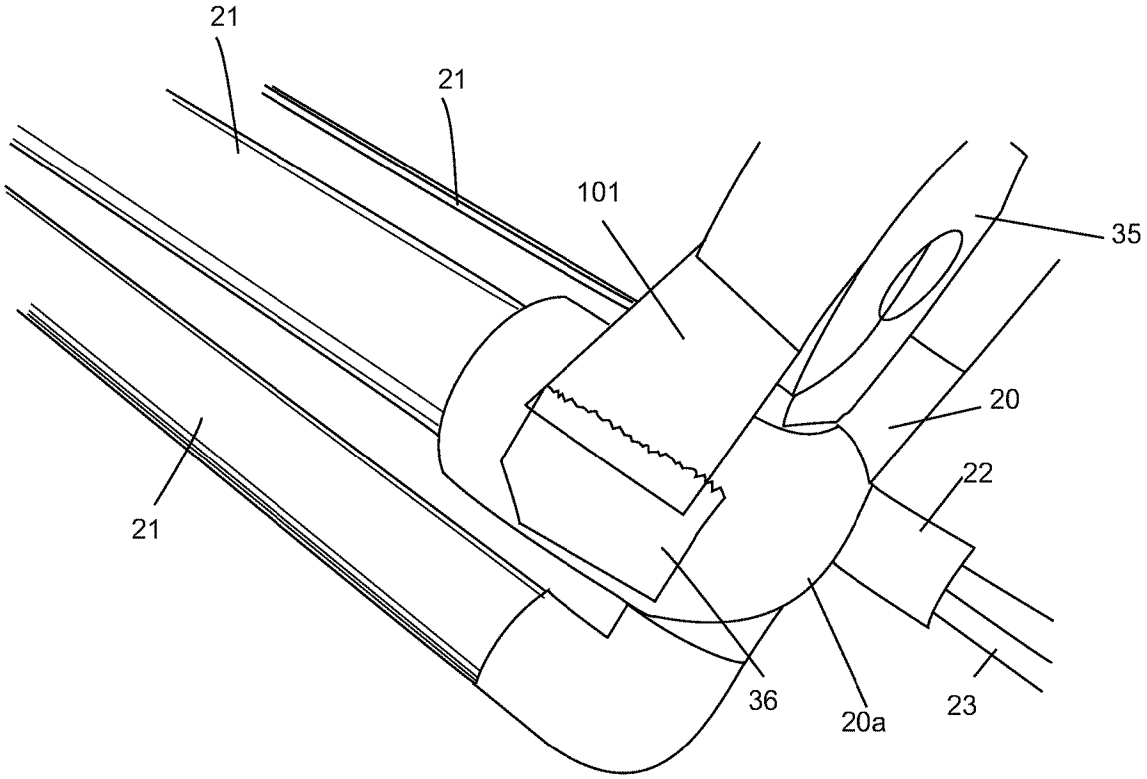
FIG. 10 is a detail view of the second embodiment showing a sawtooth cutter for the integral tape dispenser.

FIG. 9 is a detail view of the second embodiment showing an integral tape dispenser 35. In this figure, the hook end of the device is shown: note the hook 23, the hub 20, the elbows 20*a* and the tubes 21. The tape dispenser 35 is shown installed between two of the elbows. A tape saw tooth cutter 36 (see also FIG. 10) is installed on the elbow 20*a* as shown. Tape 101 is pulled off the dispenser 35 and is secured on the elbow as shown. FIG. 10 is a detail view of the second embodiment showing a sawtooth cutter 36 for the integral tape dispenser 35. As shown, the tape dispenser 35 is shown between the elbows, as discussed above. Tape 101 is shown coming from the dispenser 35 where it contacts the elbow 20*a* as shown. The saw tooth cutter 36 is shown mounted on the elbow 21. The teeth extend upwards so that the tape 101, when pulled from the dispenser 35 can be cut by pulling it across the teeth, as in a standard tape dispenser.

In this way, the device carries a complete kit for wrapping gifts-paper, ribbon and tape-on one device that can be pulled from storage, laid on a work table and used. Once finished, the device simply can be hung by the hook in a closet, out of the way.

When fresh paper is needed, one of the hubs is removed, the old roll(s) remove, new rolls added, and the hub is replaced.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A dispenser for wrapping paper and related supplies with integral storage feature comprising:

a) a first hub, having a plurality of outward receptacles formed thereon, having a plurality of fittings extending outwardly from said plurality of receptacles;

b) a second hub, having a plurality of outward receptacles formed thereon, having a plurality of fittings extending outwardly from said plurality of receptacles, spaced apart from said first hub;

c) a plurality of tubes, attached to the plurality of fittings on said first and second hubs, whereby said first hub is on the proximate end of said plurality of tubes and said second hub is on said distal end of said plurality of tubes;

d) a center tube attached to said second hub and also passing through said first hub; and e) a hook, positioned in said center shaft at said first hub and extending outwardly therefrom.

2. The dispenser of claim 1 wherein the plurality of fittings extending outwardly from the receptacles on said first hub each comprise a shaft and an open ring.

3. The dispenser of claim 2 wherein the plurality tubes passes through the plurality rings at said first hub and further wherein each of said plurality of tubes has an end cap attached to said tube.

4. The dispenser of claim 1 wherein the plurality of fittings extending outwardly from the receptacles on said second hub each comprise a 90 degree elbow fitting.

5. The dispenser of claim 1 wherein the plurality of fittings extending outwardly from the receptacles on said first and second hubs each comprise a 90 degree elbow fitting.

6. The dispenser of claim 1 wherein the hook is extendible from said center tube.

7. The dispenser of claim 1 wherein the number of receptacles on said first and second hub is 6.

8. The dispenser of claim 1 wherein the number of receptacles on said first and second hub is 4.

9. The dispenser of claim 1 further comprising a plurality of large disks being positioned on said distal end of said plurality of tubes.

10. The dispenser of claim 1 wherein one of said plurality of tubes further comprises a slot cutter formed thereon.

11. The dispenser of claim 10 wherein the slot cutter comprises:

a) a slot formed longitudinally in said tube; and b) a handle having a blade, positioned in said slot such that said handle can be slid in said slot, along the length of said slot.

12. The dispenser of claim 1 further comprising a tape dispenser, attached to said second hub.

13. The dispenser of claim 12 wherein said tape dispenser comprises:

a) a holder having a spool of tape positioned therein, said holder position on said second hub between two of said plurality of receptacles; and b) sawtooth cutter, placed on one of said receptacles on said second hub and being aligned with said holder.

14. The dispenser of claim 1 wherein said dispenser has a first position being horizontal on a work surface for use, and a second position, being suspended by said hook in a vertical position.

* * * * *